United States Patent [19]

Munnix

[11] Patent Number: 4,624,647

[45] Date of Patent: Nov. 25, 1986

[54] BUILDING ELEMENT WITH INTERNAL STUD-RECEIVING MEANS

[76] Inventor: René Munnix, 72a, Route de Maastricht, 4651 Battice, Belgium

[21] Appl. No.: 690,471

[22] Filed: Jan. 10, 1985

[30] Foreign Application Priority Data

Jan. 11, 1984 [BE] Belgium ..... 212188

[51] Int. Cl.[4] ..... A63H 33/08

[52] U.S. Cl. ..... 446/120; 446/117; 446/127; 446/95; 446/97

[58] Field of Search ..... 446/120, 124, 95, 97, 446/99, 117, 128, 127

[56] References Cited

U.S. PATENT DOCUMENTS

| | | | |
|---|---|---|---|
| 3,566,531 | 3/1971 | Hasel et al. | 446/120 |
| 3,720,015 | 3/1973 | Van der Veken | 446/71 |
| 4,217,724 | 8/1980 | Schoenfeld et al. | 446/124 X |

FOREIGN PATENT DOCUMENTS

| | | | |
|---|---|---|---|
| 1082173 | 5/1960 | Fed. Rep. of Germany | 446/120 |

*Primary Examiner*—F. Barry Shay

*Attorney, Agent, or Firm*—Young & Thompson

[57] ABSTRACT

At least one lateral face (for instance 5) has a female assembly means (8) designed to coact with an assembly stud (7) provided on another element and comprising a body (71) ending with a head (72) which is wider than said body, the female assembly means (8) consisting in a hollow zone having a first part (81) which is wider than the head (72) of the assembly stud and a second part (82) having a lesser width than that of the head of the assembly stud (7). The second part (82) of the female assembly means (8) has a housing (72) in its interior designed to receive tightly the head (72) of the assembly stud. In an advantageous example of the embodiment, said housing (83) is comprised by two internal ribs (84).

4 Claims, 7 Drawing Figures

FIG. 1
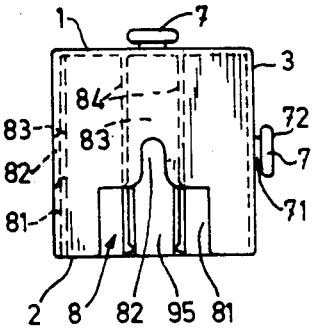
FIG. 2
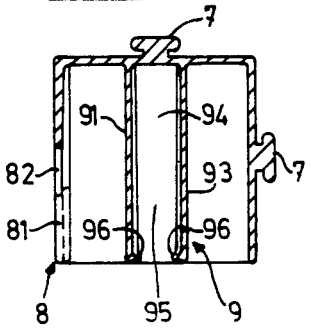
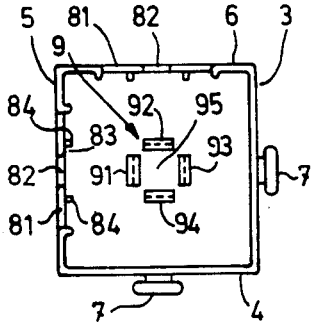
FIG. 3
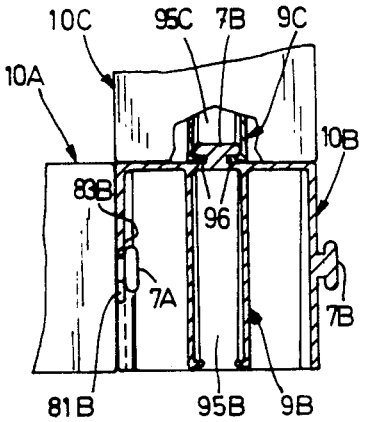
FIG. 4

BUILDING ELEMENT WITH INTERNAL STUD-RECEIVING MEANS

The present invention concerns an element for a building block system that allows being assembled with other elements by simple encasing and/or hooking to build various assemblies.

Commercial building elements are known having female type assembly means on their lower face and male assembly means on their upper face in order to allow assembling several elements by encasing the male and female assembly means. In these elements, the lateral faces are smooth and thus inactive, that is they do not allow being coupled with faces of other elements. This limits the assembly and building possibilities.

The object of the invention is an element for building block system that allows assembling several elements not only by simple encasing but also by hooking on their lateral faces in order to diversify the assembly possibilities with excellent stability.

This object is attained according to the invention by a building element characterized in that at least one lateral face has a female assembly means designed to coact with an assembly stud provided on another element and having a body ending with a head wider than this body, the female assembly means consisting of a hollow zone having a first part wider than the head of the assembly stud and a second part having a lesser width than that of the head of the stud and at least as great as the width of the stud body, the second part having a housing in its interior designed to hold tightly the head of the assembly stud.

The building element according to the invention allows in this way hooking an element on a lateral face of another element and building a wider variety and more elaborate types of assemblies than those of known building elements having inactive lateral faces.

The invention is explained in detail in the following by means of an example of an embodiment shown in the accompanying drawings:

FIG. 1 is an elevational view of an example of a cubic embodiment;

FIG. 2 shows a vertical section of the element according to FIG. 1;

FIG. 3 is a view from below of the element according to FIG. 1;

FIG. 4 shows an assembly of three building elements according to FIG. 1; in this drawing one element is shown in vertical section and another one is shown partially broken away showing the way of encasing the two elements;

Figure 5:
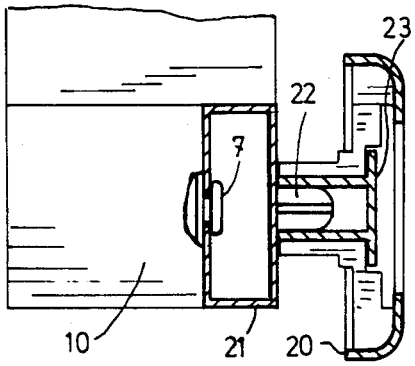
FIGS. 5 and 6 show two different ways of assembling moving element(s)

The building element according to the invention can have any kind of shape. The accompanying drawings show an example of an embodiment having a cubic shape. The element is hollow and its base is open. This element is characterized by active lateral faces, that is, they are provided with either male or female assembly means. In greater detail, the upper face 1 and each of two consecutive lateral faces 3 and 4 have an assembly stud 7 comprising a body 71 ending with a flat head 72 which is larger than the body 71. The head 72 has preferably a square or octagonal shape. Each of the two other lateral faces 5 and 6 has a female assembly means

8. This consists of a hollow zone having a wide part 81 and a narrow part 82. The width of the part 81 is sufficiently great to allow the passage of the head 72 of an assembly stud 7. The width of the part 82 is less than that of the head 72 of a stud 7 and at least as great as that of the body 71 of the stud. The part 82 is internally provided with a housing 83 to hold tightly the head 72 of the assembly stud 7. In this case, the internal housing is comprised by two ribs 84 (FIGS. 1 and 3) forming a channel designed to enclose the head of the stud 7. The internal housing can equally be comprised, as an example, by a channel extending about the periphery of the narrow part 82. This channel could be comprised by for instance a narrowing to ensure the tightening and/or the holding of the head of the stud enclosed therein. The edge of the narrow part 82 can equally be comprised by one or several holding notches to coact with one or more complementary elements provided on the body 71 of the assembly head 7, for instance one or several grooves or projections in order to hold the body of the stud 7 whose head 72 is placed in the housing 83. Thanks to these provisions according to the invention, it is possible to hook an element onto a lateral face of another element simply by sliding the head 72 of an assembly stud 7 into the housing 83 having internally the narrow part 82 of a female zone 8 of the other element, the body 71 of the stud 7 being positioned in the opening of the narrow part 82, if desired with an adequate tightness. FIG. 4 shows an element 10A hooked on the left lateral face of the element 10B, the stud 7A of the element 10A being held in the housing 83B of the element 10B, forming in this way a stable assembly.

The lateral faces can be provided in any number and with any distribution of the male and female assembly means. One or the other base of the element, or both of them, can equally be provided with encasing means. In the example shown in the enclosed drawings, the upper base 1 of the element has an assembly stud 7 like the lateral faces 3 and 4.

The one or the other base of the element can equally be provided with one or more female encasing means, each of them designed to receive the head of an assembly stud. The element shown in the enclosed drawings, for instance, is hollow with its lower base 2 open and in the internal cavity of the element an arrangement is provided having a hollow encasing means 9 generally of a prismatic shape. This encasing means is preferably comprised by lamellae such as lamellae 91–94 delimiting an internal opening 95 to receive and enclose the head 72 of an assembly stud 7 of another element. The opening 95 is preferably slightly smaller than the surface of the head of the stud, so that when the head of a stud is inserted into this opening 95, the ends of the lamellae 91–94 move away from each other to enclose between them the head of a stud as represented in FIG. 4 in which one can see an element 10C joined to the element 10B. The opening 95C of the joining means of the element 10C covers the head of the upper stud 7B of the element 10B. The external edge 96 of the lamellae is advantageously inclined towards the inside of the opening 95 in order to facilitate the insertion and ensure the retention of the head of the assembly stud. In order to attain the same end, the edge of the heads of the studs 7 is equally inclined or rounded.

Figure 6:
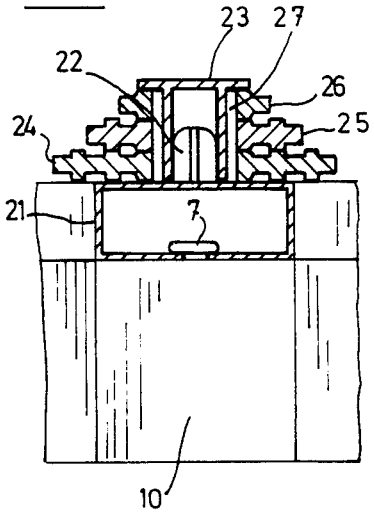

Thanks to the building element according to the invention which allows hooking another element on a lateral face, it is possible to build assemblies which are of a wider variety and more complex than those of building elements having inactive lateral faces. The assemblies which can be built in this way can comprise not only stationary elements but also moving ones. FIGS. 5 and 6 show two examples of an assembly for moving elements. In the example shown in FIG. 5 a wheel 20 is provided on a face of an element 10 according to the invention. On an assembly stud 7 of this element, an adapter 21 is hooked having a face provided with a female assembly means 8 according to the invention and having the opposite face provided with a stud 22 designed to be tightly positioned in an opening of a hub 23 on which the wheel 20 can be positioned which is capable of turning freely around said hub.

Instead of a wheel, one or several moving gear discs can be provided as shown as an example in FIG. 6 in which three discs 24, 25, 26 are represented. These discs which, in this case, as an example, are joined to each other by means of an intermediate part 27, can engage with other complementary discs provided on other elements.

Figure 7:
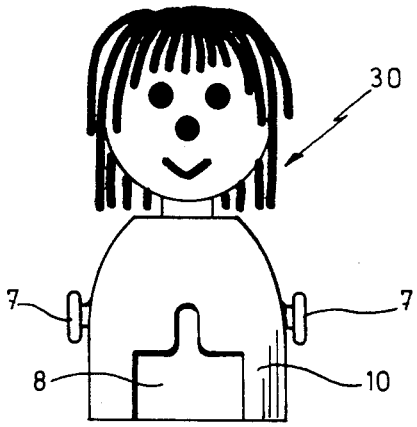
FIG. 7 shows an example of another embodiment of an element according to the invention.

Obviously, the shape of the elements and their arrangement can be varied as desired. In particular, the elements do not necessarily need to have a prismatic shape with a square or rectangular base, as this base can have a triangular or even any polygonal shape, and they do not even need to have a pure geometrical shape as long as they have at least a suitable lateral face. Just to mention a different example, certain elements can be built having the shape of a puppet or any subject or form. FIG. 7 shows as an example an element having the form of a puppet. In this example of an embodiment, the puppet 30 has its bottom part 10 of a prismatic shape designed according to the invention. The lateral faces are provided with hooking assembly means according to the invention. The example shows three faces, two of which have a stud 7 and the front face has a female assembly means 8, as described above.

I claim:

1. An element for building block system comprising a plurality of block elements to be assembled to one another in spatial configuration, said element comprising a hollow substantially prismatic body with lateral walls and a top base wall, at least one of said walls having a male assembling stud protruding externally therefrom, said assembling stud comprising a body protruding from said one wall and ending with a head which is wider than said body, and at least one of said lateral walls having a female assembling means for engagement with a said assembling stud provided on a face of another element of said system, the female assembling means consisting of a first generally rectangular-shaped aperture which is wider than the head of said male assembling stud and a second aperture adjacent to and communicating with the first aperture and centrally located with respect to one side of said first aperture, said second aperture having a lesser width than that of the head of said male assembling stud and at least as great as the width of the stud body, the wall comprising said second aperture being formed internally with means including a channel adapted tightly to engage with the head of one of said male assembling studs on another of said elements, whereby said another element is connected to the element in hook-up engagement in a face-to-face arrangement, said top base wall having internally a protruding hollow encasing means of a generally prismatic shape dimensioned so as to engage for connection therewith the head of said male assembling stud on another element, said hollow encasing means being constituted by a number of lamellae delimiting an internal opening for enclosing the head of a said male assembling stud, said element having means at the side remote from said top base for providing access to said encasing means by a said male assembling stud.

2. An element according to claim 1, wherein said male assembling stud has a bevel-edged head so as to facilitate the engagement of said head into said internal channel adjacent to said second aperture in a lateral wall of another element and into said internal encasing means.

3. An element according to claim 1, wherein the said channel is comprised of two internal ribs formed internally on the lateral wall and extending on both sides of said second aperture so as to enclose therebetween the head of a said male assembling stud.

4. An element according to claim 1, wherein the external edge of said lamellae is shaped so as to facilitate encasing and to ensure retaining the head of a said male assembling stud.

* * * * *